US011246414B1

(12) United States Patent
Novak

(10) Patent No.: US 11,246,414 B1
(45) Date of Patent: Feb. 15, 2022

(54) FURNITURE LEG PROTECTOR APPARATUS

(71) Applicant: Andrew Novak, Dallas, TX (US)

(72) Inventor: Andrew Novak, Dallas, TX (US)

( * ) Notice: Subject to any disclaimer, the term of this patent is extended or adjusted under 35 U.S.C. 154(b) by 0 days.

(21) Appl. No.: 17/143,272

(22) Filed: Jan. 7, 2021

(51) Int. Cl.
*A47B 91/00* (2006.01)
*A47B 91/12* (2006.01)

(52) U.S. Cl.
CPC ..... *A47B 91/12* (2013.01)

(58) Field of Classification Search
None
See application file for complete search history.

(56) References Cited

U.S. PATENT DOCUMENTS 4,323,610 A * 4/1982 Leverich ..... A47B 95/043 428/100
4,443,508 A 4/1984 Mehl
4,999,233 A 3/1991 Probst
5,149,575 A 9/1992 Soifer
5,603,140 A * 2/1997 Pryce ..... E04F 19/028 16/18 CG
6,378,831 B1 4/2002 Copeland
6,647,589 B1 * 11/2003 Youngwith ..... A47C 31/11 16/18 CG
9,060,615 B1 6/2015 Jaeger
D801,798 S 11/2017 Teng
2005/0076445 A1 * 4/2005 MacEachern ..... A47C 7/002 5/663
2007/0204430 A1 * 9/2007 Chase ..... A47B 91/06 16/42 R
2013/0019410 A1 * 1/2013 Willis ..... A47B 91/12 5/663
2014/0106099 A1 * 4/2014 Desmarais ..... A47B 91/002 428/36.1
2015/0216305 A1 * 8/2015 Rondina ..... A47B 91/04 16/30
2020/0093265 A1 * 3/2020 Becker ..... A47B 91/12

FOREIGN PATENT DOCUMENTS

WO WO0049247 8/2000

* cited by examiner

*Primary Examiner* — Steven M Marsh

(57) ABSTRACT

A furniture leg protector apparatus for preventing stubbed toes includes an anchor base having a base top side, a base bottom side, and a base perimeter. The base top side is placed underneath a leg of a furniture item. A wraparound backing has a backing top edge, a backing bottom edge, a backing left edge, a backing right edge, a backing inner face, and a backing outer face. A midpoint of the backing bottom edge is coupled to the base top side proximal the base perimeter. The wraparound backing moves between a planar position and a wrapped position to encompass the leg of the furniture item with the backing inner face. An outer layer is coupled to the wraparound backing. The outer layer is continuously coupled to the backing outer face and is sufficiently shock-absorptive to prevent injury to a person's toes when accidentally kicked.

9 Claims, 6 Drawing Sheets

FURNITURE LEG PROTECTOR APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to furniture protector devices and more particularly pertains to a new furniture protector device for preventing stubbed toes. The present invention includes an anchor base and a wraparound backing. A shock absorptive outer surface is coupled to the wraparound backing.

(2) Description of Related Art Including Information Disclosed Under 37 CFR 1.97 and 1.98

The prior art relates to furniture protector devices. Known devices clip or adhere to a furniture leg or edge. These devices lack a base with an attached wraparound portion. Known devices also do not include a gel-filled outer layer for shock absorption.

BRIEF SUMMARY OF THE INVENTION

An embodiment of the disclosure meets the needs presented above by generally comprising an anchor base having a base top side, a base bottom side, and a base perimeter. The base top side is configured to be placed underneath a leg of a furniture item. A wraparound backing is coupled to the anchor base. The wraparound backing has a backing top edge, a backing bottom edge, a backing left edge, a backing right edge, a backing inner face, and a backing outer face. A midpoint of the backing bottom edge is coupled to the base top side proximal the base perimeter. The wraparound backing moves between a planar position and a wrapped position. The wrapped position is configured to encompass the leg of the furniture item with the backing inner face. An outer layer is coupled to the wraparound backing. The outer layer is continuously coupled to the backing outer face and is sufficiently shock-absorptive to prevent injury to a person's toes when accidentally kicked.

An alternative embodiment of the disclosure generally comprises an anchor base having a base top side, a base bottom side, and a base perimeter. The base top side is configured to be placed underneath a leg of a furniture item. A wraparound backing is coupled to the anchor base. The wraparound backing has a backing top edge, a backing bottom edge, a backing left edge, a backing right edge, a backing inner face, and a backing outer face. The backing bottom edge is coupled to the base top side adjacent the base perimeter excepting an open portion. The wraparound backing is configured to partially cover the leg of the furniture item with the backing inner face. An outer layer is coupled to the wraparound backing. The outer layer is continuously coupled to the backing outer face and is sufficiently shock-absorptive to prevent injury to a person's toes when accidentally kicked.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
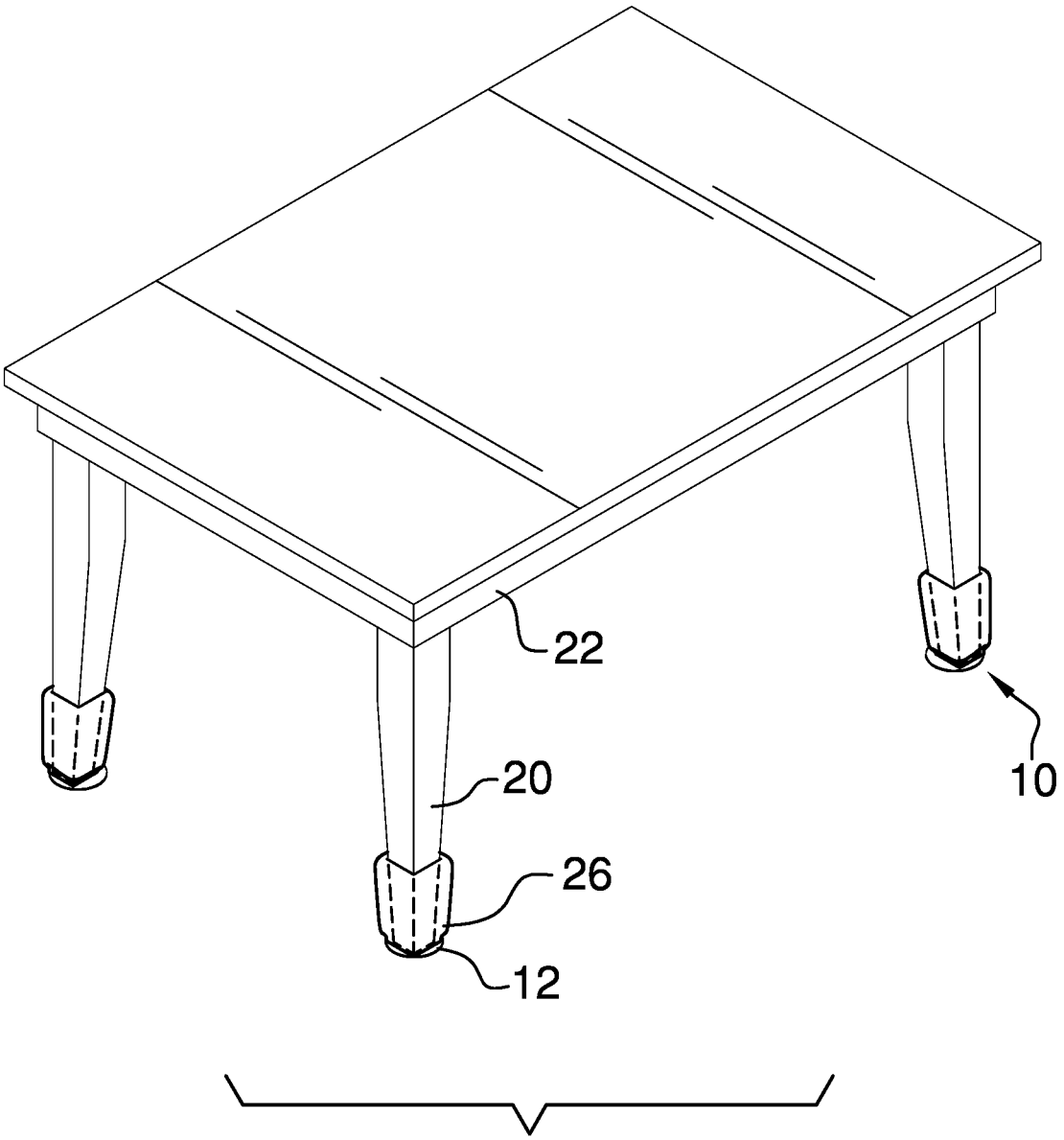
FIG. 1 is an isometric in-use view of a furniture leg protector apparatus according to an embodiment of the disclosure.
Figure 2:
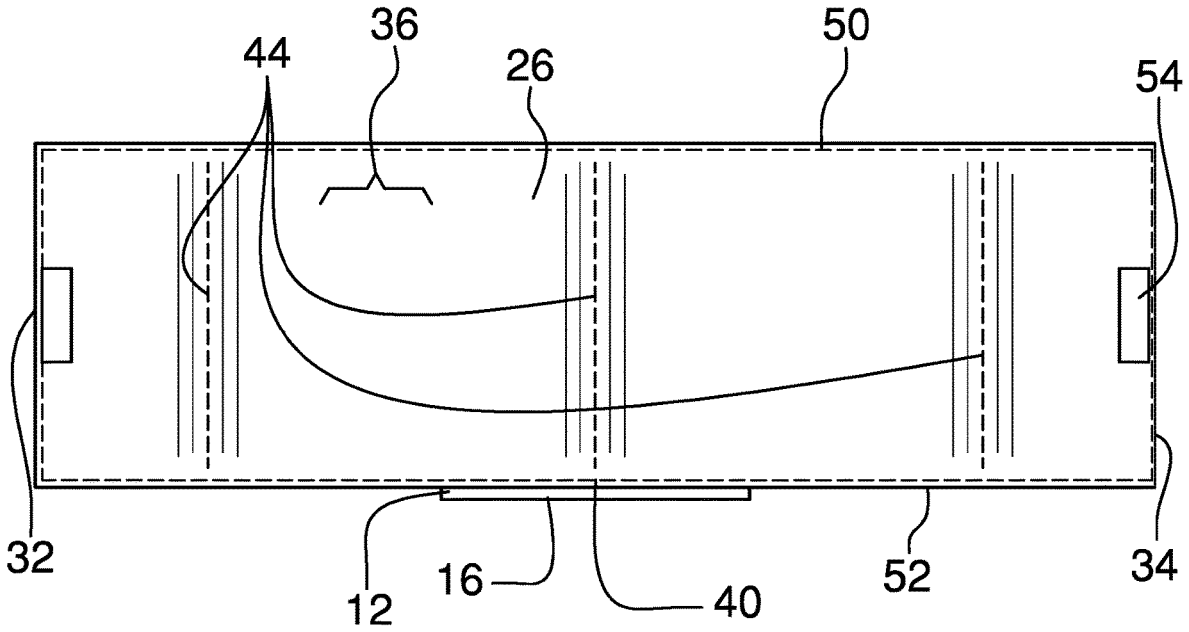
FIG. 2 is a front elevation view of an embodiment of the disclosure.
Figure 3:
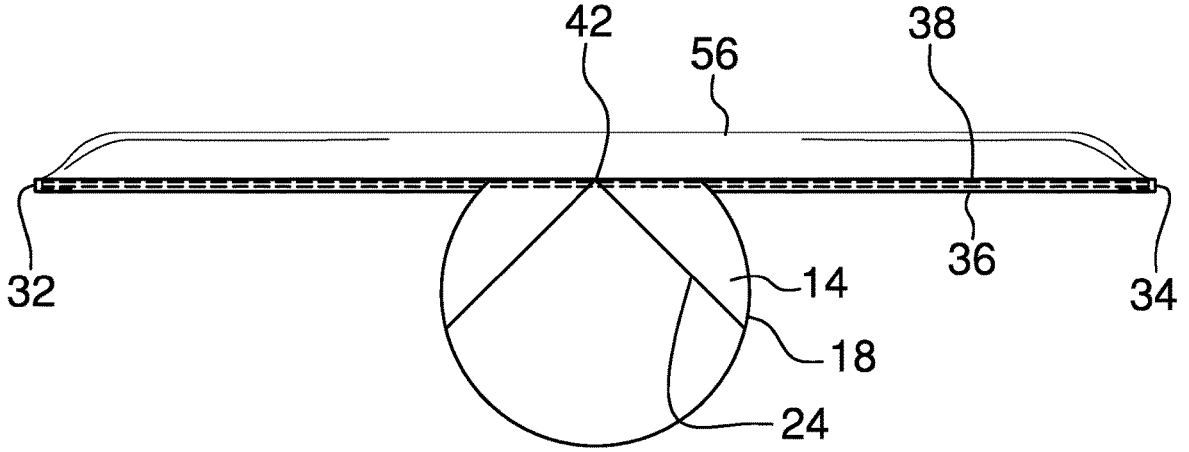
FIG. 3 is a top plan view of an embodiment of the disclosure.
Figure 4:
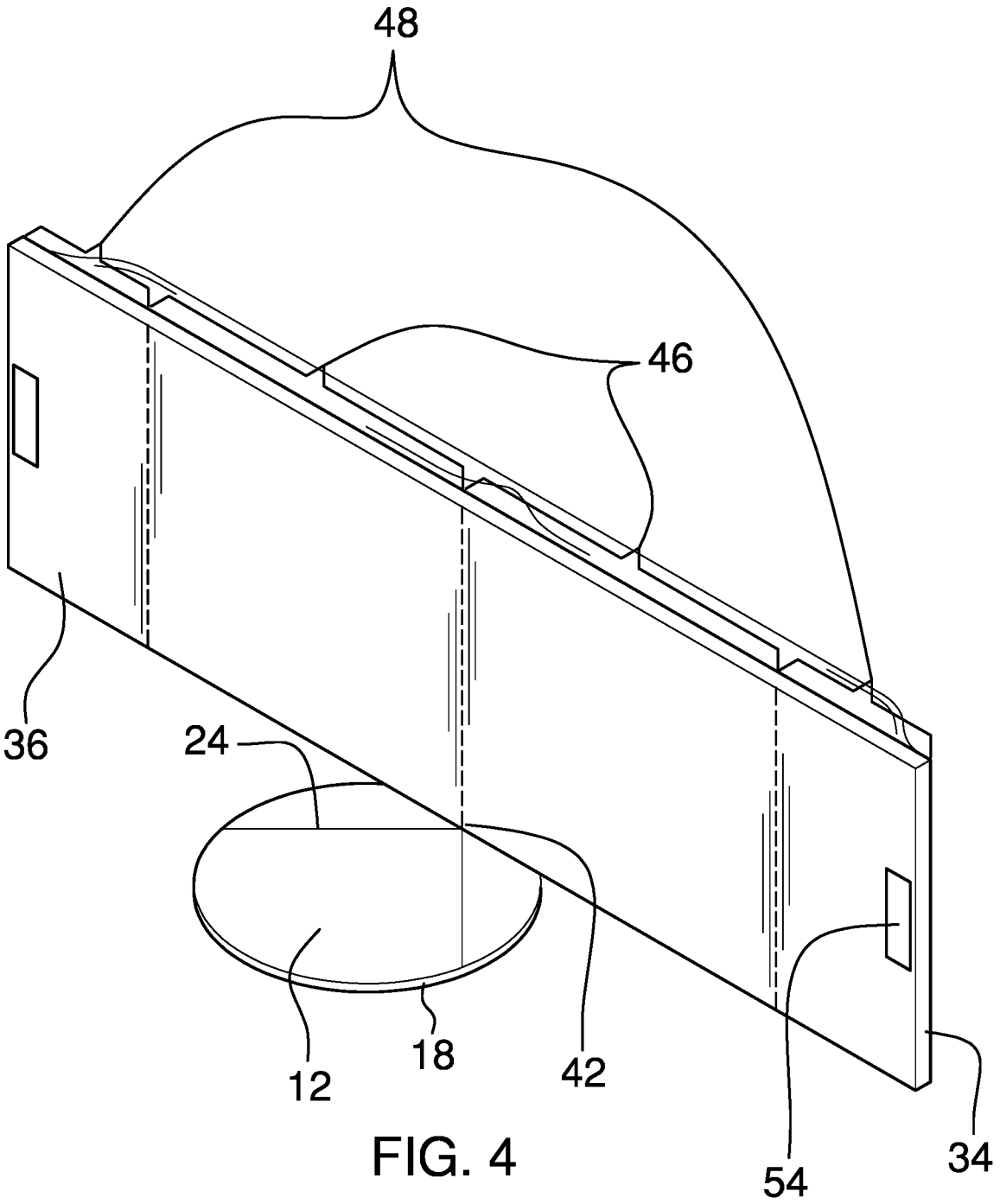
FIG. 4 is an isometric view of an embodiment of the disclosure.
Figure 5:
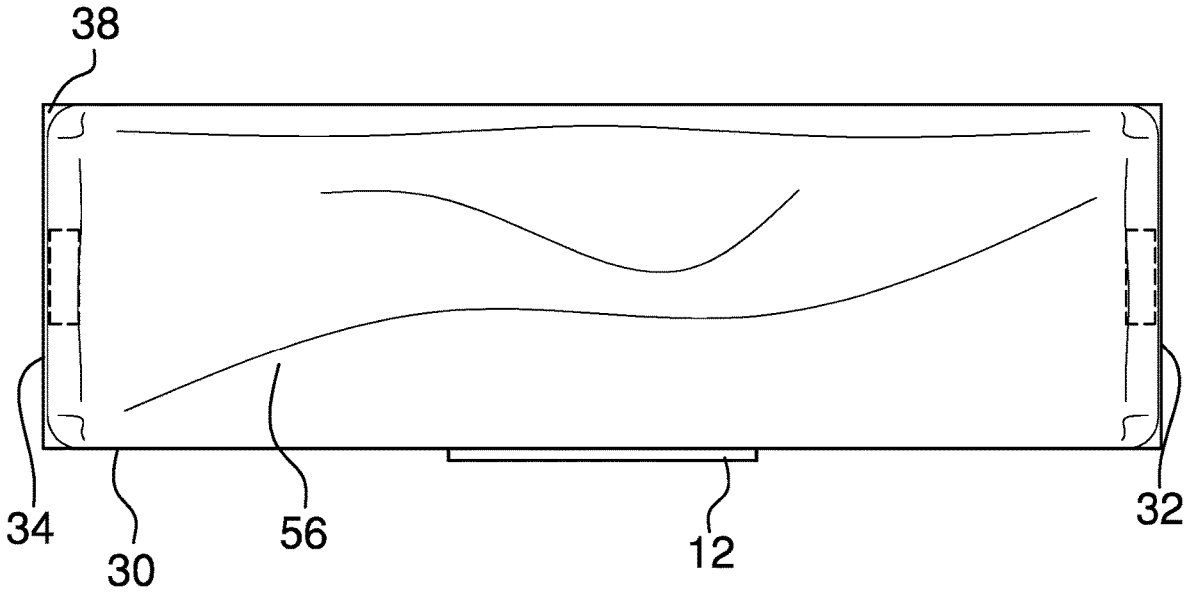
FIG. 5 is a rear elevation view of an embodiment of the disclosure.

With reference now to the drawings, and in particular to FIGS. 1 through 7 thereof, a new furniture protector device embodying the principles and concepts of an embodiment of the disclosure and generally designated by the reference numeral 10 will be described.

As best illustrated in FIGS. 1 through 7, the furniture leg protector apparatus 10 generally comprises an anchor base 12 having a base top side 14, a base bottom side 16, and a base perimeter 18. The base top side 14 is configured to be placed underneath a leg 20 of a furniture item 22. The anchor base 12 may be circular with the base top side having a wedge portion 24 configured to receive the leg 20 of the furniture item.

A wraparound backing 26 is coupled to the anchor base 12. The wraparound backing 26 has a backing top edge 28, a backing bottom edge 30, a backing left edge 32, a backing right edge 34, a backing inner face 36, and a backing outer face 38. A midpoint 40 of the backing bottom edge 30 is coupled to the base top side 14 proximal the base perimeter 18. The midpoint 40 may be coupled to the base top side 14 at an apex 42 of the wedge portion. The wraparound backing 26 moves between a planar position shown in FIGS. 2-4 and a wrapped position shown in FIG. 1. The wrapped position is configured to encompass the leg 20 of the furniture item with the backing inner face 36.

The wraparound backing 26 may have a plurality of vertical joints 44 extending from the backing top edge 28 to the backing bottom edge 30. The plurality of vertical joints 44 divides the wraparound backing 26 into a pair of medial portions 46 and a pair of distal portions 48. The width of each distal portion 48 may be half of the width of each medial portion 46. In the wrapped position the pair of distal portions 48 thus join together to cover an equal part of the furniture item 22 as each of the medial portions 46. The wraparound backing 26 may include a snapback core 50 and a rubberized shell 52 continuously disposed on the snapback core 50. The snapback core 50 is based towards the wrapped position but will maintain the planar position until pressure is applied to one of the plurality of vertical joints 44 at which point the snapback core 50 will "snap" and curl around the leg 20 to the wrapped position.

A pair of selectively engageable fasteners 54 may be coupled to the wraparound backing 26. The pair of selectively engageable fasteners 54 is coupled to the backing inner face 36 adjacent the backing left edge 32 and the backing right edge 34 to maintain the wrapped position. The pair of selectively engageable fasteners 54 may be a pair of engagement members such as, but not limited to, magnets, hook-and-loop, snaps, and the like.

An outer layer 56 is coupled to the wraparound backing 26 and is continuously coupled to the backing outer face 38. The outer layer 56 is sufficiently shock-absorptive to prevent injury to a person's toes when accidentally kicked. The outer layer 56 may be gel-filled to improve shock-absorption while maintaining flexibility to easily move from the planar position to the wrapped position. The thickness of the outer layer 56 may be more than twice the thickness of the wraparound backing 26.

Figure 6:
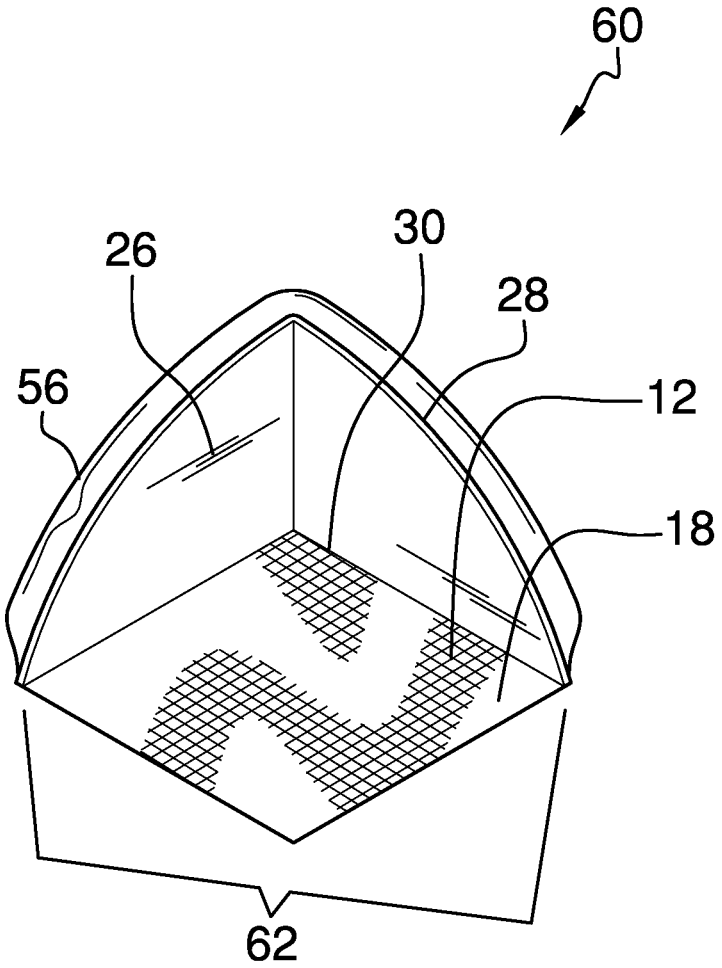
FIG. 6 is an isometric view of an embodiment of the disclosure.
Figure 7:
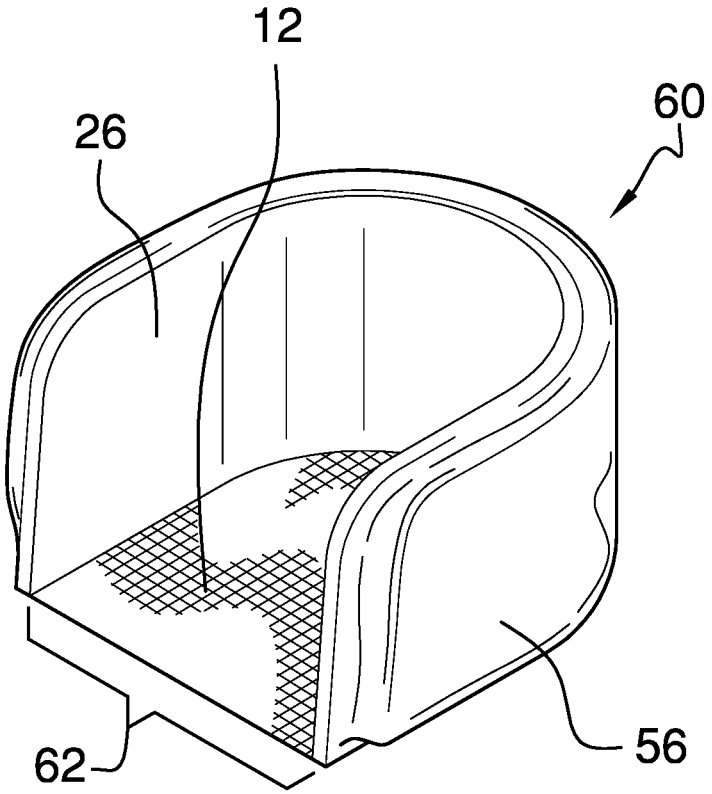
FIG. 7 is an isometric view of an embodiment of the disclosure.

An alternative embodiment 60 is shown in FIGS. 6 and 7 in which the backing bottom edge 30 is continuously coupled around the base perimeter 18 excepting an open portion 62 thereof. The open portion 62 receives the leg 20.

In use, the anchor base 12 is placed beneath each leg 20 and the wraparound backing 26 is moved to the wrapped position. The pair selectively engageable fasteners 54 is then engaged to secure this position. The user may then navigate the space knowing that if they accidentally kick or the leg 20 the outer layer 56 will provide sufficient shock-absorption to prevent injury.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A furniture leg protector apparatus comprising:

an anchor base having a base top side, a base bottom side, and a base perimeter, the base top side being configured to be placed underneath a leg of a furniture item;

a wraparound backing coupled to the anchor base, the wraparound backing having a backing top edge, a backing bottom edge, a backing left edge, a backing right edge, a backing inner face, and a backing outer face, a midpoint of the backing bottom edge being coupled to the base top side proximal the base perimeter, the wraparound backing moving between a planar position and a wrapped position, the wrapped position being configured to encompass the leg of the furniture item with the backing inner face;

an outer layer coupled to the wraparound backing, the outer layer being continuously coupled to the backing outer face, the outer layer being sufficiently shock-absorptive to prevent injury to a person's toes when accidentally kicked; and the wraparound backing including a snapback core and a rubberized shell continuously disposed on the snapback core, the snapback core being based towards the wrapped position.

2. The furniture leg protector apparatus of claim 1 further comprising a pair of selectively engageable fasteners coupled to the wraparound backing, the pair of selectively engageable fasteners being coupled to the backing inner face adjacent the backing left edge and the backing right edge to maintain the wrapped position.

3. The furniture leg protector apparatus of claim 1 further comprising the wraparound backing having a plurality of vertical joints extending from the backing top edge to the backing bottom edge.

4. The furniture leg protector apparatus of claim 3 further comprising the plurality of vertical joints dividing the wraparound backing into a pair of medial portions and a pair of distal portions, the width of each distal portion being half of the width of each medial portion.

5. The furniture leg protector apparatus of claim 1 further comprising the anchor base being circular, the base top side having a wedge portion configured to receive the leg of the furniture item.

6. A furniture leg protector apparatus comprising:

an anchor base having a base top side, a base bottom side, and a base perimeter, the base top side being configured to be placed underneath a leg of a furniture item, the anchor base being circular, the base top side having a wedge portion configured to receive the leg of the furniture item;

a wraparound backing coupled to the anchor base, the wraparound backing having a backing top edge, a backing bottom edge, a backing left edge, a backing right edge, a backing inner face, and a backing outer face, a midpoint of the backing bottom edge being coupled to the base top side proximal the base perimeter, the wraparound backing moving between a planar position and a wrapped position, the wrapped position being configured to encompass the leg of the furniture item with the backing inner face; and an outer layer coupled to the wraparound backing, the outer layer being continuously coupled to the backing outer face, the outer layer being sufficiently shock-absorptive to prevent injury to a person's toes when accidentally kicked; and the wraparound backing being coupled to the base top side at an apex of the wedge portion.

7. The furniture leg protector apparatus of claim 1 further comprising the outer layer being gel-filled.

8. The furniture leg protector apparatus of claim 1 further comprising the thickness of the outer layer being more than twice the thickness of the wraparound backing.

9. A furniture leg protector apparatus comprising:

an anchor base having a base top side, a base bottom side, and a base perimeter, the base top side being configured to be placed underneath a leg of a furniture item, the anchor base being circular, the base top side having a wedge portion configured to receive the leg of the furniture item;

a wraparound backing coupled to the anchor base, the wraparound backing having a backing top edge, a backing bottom edge, a backing left edge, a backing right edge, a backing inner face, and a backing outer face, a midpoint of the backing bottom edge being coupled to the base top side proximal the base perimeter, the midpoint being coupled to the base top side at an apex of the wedge portion, the wraparound backing moving between a planar position and a wrapped position, the wrapped position being configured to encompass the leg of the furniture item with the backing inner face, the wraparound backing having a plurality of vertical joints extending from the backing top edge to the backing bottom edge, the plurality of vertical joints dividing the wraparound backing into a pair of medial portions and a pair of distal portions, the width of each distal portion being half of the width of each medial portion, the wraparound backing including a snapback core and a rubberized shell continuously disposed on the snapback core, the snapback core being based towards the wrapped position;

a pair of selectively engageable fasteners coupled to the wraparound backing, the pair of selectively engageable fasteners being coupled to the backing inner face adjacent the backing left edge and the backing right edge to maintain the wrapped position; and an outer layer coupled to the wraparound backing, the outer layer being continuously coupled to the backing outer face, the outer layer being sufficiently shock-absorptive to prevent injury to a person's toes when accidentally kicked, the outer layer being gel-filled, the thickness of the outer layer being more than twice the thickness of the wraparound backing.

* * * * *